US007364471B2

(12) United States Patent
Takahashi et al.

(10) Patent No.: US 7,364,471 B2
(45) Date of Patent: Apr. 29, 2008

(54) CARD CONNECTOR

(75) Inventors: Hirokazu Takahashi, Tokyo (JP); Hitoshi Kikuchi, Tokyo (JP); Hiromichi Kato, Tokyo (JP); Kazunori Takei, Tokyo (JP)

(73) Assignee: DDK, Ltd., Tokyo (JP)

( * ) Notice: Subject to any disclaimer, the term of this patent is extended or adjusted under 35 U.S.C. 154(b) by 0 days.

(21) Appl. No.: 11/373,452

(22) Filed: Mar. 9, 2006

(65) Prior Publication Data

US 2006/0234559 A1 Oct. 19, 2006

(30) Foreign Application Priority Data

Apr. 18, 2005 (JP) ..... 2005-119494

(51) Int. Cl.
*H01R 13/64* (2006.01)

(52) U.S. Cl. ..... 439/680; 439/630

(58) Field of Classification Search ..... 439/680, 439/630, 607–610, 159, 160, 155, 152, 573
See application file for complete search history.

(56) References Cited

U.S. PATENT DOCUMENTS 6,162,069 A * 12/2000 Choy ..... 439/92
6,394,827 B2 * 5/2002 Nogami ..... 439/159
6,722,921 B1 * 4/2004 Yu ..... 439/573
6,749,450 B1 * 6/2004 Chen ..... 439/188
2006/0189213 A1 * 8/2006 Hsiao ..... 439/630

FOREIGN PATENT DOCUMENTS

| | | |
|---|---|---|
| JP | 2001-135384 | 5/2001 |
| JP | 2001-351709 | 12/2001 |
| JP | 2001-357917 | 12/2001 |
| JP | 2004-321645 A | 11/2004 |
| JP | 2006-134687 A | 5/2006 |

* cited by examiner

*Primary Examiner*—Edwin A. Leon
(74) *Attorney, Agent, or Firm*—Sughrue Mion PLLC

(57) ABSTRACT

A card connector into and from which at least one card is inserted and removed includes a plurality of contacts each having a contact portion adapted to contact the card, and a housing arranging and holding the contacts and having a fitting opening into which the card is inserted. The housing is provided with a terminal at one end in the width direction of the housing for achieving continuity between the card and a substrate and precluding the card from being erroneously inserted with its rear end or upside down, and the housing is further provided with a notch at a predetermined position for permitting part of the terminal to extend into the fitting opening. The card connector achieves its miniaturization and is able to prevent troubles caused by the electro-static discharge and an erroneous insertion of a card into the card connector.

11 Claims, 4 Drawing Sheets

CARD CONNECTOR

BACKGROUND OF THE INVENTION

This invention relates to a card connector for use in electric and electronic appliances in instruments and for use in printers and card readers and more particularly to a card connector capable of preventing troubles caused by electrostatic discharge (ESD) and precluding erroneous insertion of a card with its rear end into the card connector.

There have been many kinds of cards as media for a wide variety of information. It has been a common practice to acquire or store various information from or onto a card inserted into a card connector connected to an information appliance.

In order to connect cards to a card connector, the connector is provided with a plurality of fitting openings for receiving a required number of cards therein or a fitting opening common to a plurality of cards, and contact portions of contacts extend into the fitting opening or openings so as to bring the cards into contact with the contact portions of the contacts, thereby achieving continuity therebetween.

There are some cards which may lack a measure for troubles caused by electro-static discharge (ESD) and a measure for precluding erroneous insertion of a card with its rear end. On the other hand, various card connectors have been proposed in the following Patent Literatures 1 to 4. A card connector capable of precluding erroneous insertion of a card with it rear end has been disclosed in the Patent Literature 1. The Patent Literatures 2, 3 and 4 have disclosed card connectors whose fitting openings for inserting cards thereinto are arranged one above the other, while the Patent Literatures 3 and 4 have disclosed connectors having a fitting opening capable of receiving a plurality of cards.

Patent Literature 1

According to the Abstract of Japanese Patent Application Opened No. 2001-135,384, this invention has an object to provide a card connector capable of maintaining reliability of good connection without any damage to an IC card which has been erroneously inserted. Disclosed in the Patent Literature 1 is a card connector including a main body comprising a side portion for guiding a side edge of an IC card, a bottom portion having a support surface for supporting the surface or rear surface of the IC card and formed with stepped portions into which convex surface formed on the rear surface of the card is caused to be fitted movably along the inserting and removing direction X when the card is supported with its rear surface, and an upper plate portion for regulating the rising of the IC card onto the flat surface side. The upper plate portion comprises a regulating surface for regulating the rising of the card onto the flat surface side and a fitting groove into which the convex surface of the rear surface is movably fitted along the inserting and removing direction of the card under a condition that the regulating surface and rear surface of the card are facing to each other.

Patent Literature 2

According to the Abstract of Japanese Patent Application Opened No. 2001-357,917, this invention has an object to provide a method for arranging contacts of a connector for memory cards, which is able to receive cards in a plurality of inserting openings arranged one above the other and to bring the contacts for the plurality of inserting openings into contact with substrates with ease, even if the occupied areas of the substrates are narrow. Disclosed in the Patent Literature 2 is the method for arranging contacts of a memory card connector comprising a housing having fitting openings for receiving two cards, and the contacts held and fixed by the housing, wherein the contacts adapted to contact a card inserted into the upper inserting opening are arranged to extend in both width directions of the housing and to be connected to patterns of the substrate. As shown in FIG. 1 of the Patent Literature 2, the fitting openings for receiving cards are arranged one above the other.

Patent Literature 3

According to the Abstract of Japanese Patent Application Opened No. 2001-351,709, this invention has an object to provide a connector into which a plurality of memory cards different in thickness are selectively inserted for operating information appliances. A connector main body comprises side walls on both sides and a rear wall, the side walls being formed with receiving portions along their length adapted to conform to side edges of memory cards. The connector comprises card identification terminals arranged one above the other on the inner surface of the side wall, terminals suitably provided on the rear wall for acquiring the accumulated information in the cards and writing electronic information to cards, and protective terminals arranged at suitable positions on the other side wall for prohibiting writing. The card identification terminals are formed by spring-like metal strips and arranged one above the other on one side wall of the connector, while identification tabs for identifying the existence of cards by contacting the respective card identification terminal are arranged on the side wall and spaced from the card identification terminals when no card is inserted. As shown in FIGS. 7 and 8, fitting openings for receiving cards are suitably arranged one above the other.

Patent Literature 4

According to the Abstract of Japanese Patent Application No. 2004-321,645, this invention has an object to provide a card connector which is easy to assemble and superior in mounting operationality by a customer without limiting the freedom of design of substrates and connector, and without complicating the arrangement of connection portions of contacts. Disclosed in this application is a card connector into and from which a plurality of cards are inserted and removed, including a required number of contacts each having a contact portion adapted to contact a card, and a housing arranging and holding the contacts and having one or a plurality of fitting openings into which a card or cards are inserted, wherein the contacts each comprise at least two contact portions adapted to contact at least two cards, thereby enabling one contact to be in contact with at least two cards. As shown in FIG. 1 in the Patent Literature 4, the fitting openings are arranged one above the other, although they have portions common to the two cards.

In recent years, miniaturizations have proceeded in the information appliances as well as substrates or boards used therein so that areas to be occupied by the substrates have become extremely narrower. Such a limitation of the areas occupied by the substrates necessarily leads to the use of a plurality of substrates. On the other hand, if a plurality of connectors are required for exchanging a plurality of memory cards, information appliances would become bulky which would be inconvenient for carrying them.

There are some cards not having a measure for electrostatic discharge (ESD). When such a card is inserted into a card connector, the accumulated static electricity in the card would flow through contacts to a substrate, frequently resulting in damage to it, which is a problem to be solved.

Moreover, there are some cards not having a measure for preventing erroneous insertion of the card into a card connector. When such a card is inserted into the card connector, the card itself frequently would be damaged, or contacts would be damaged (or buckled), causing the need to exchange a substrate itself.

If measures for the electro-static discharge (ESD) and for precluding an erroneous insertion of a card with its rear end are individually pursued, a resulting connector would be obliged to be bulky so that the requirements for the miniaturization of connector and hence information appliances would be impeded.

SUMMARY OF THE INVENTION

It is an object of the invention to provide a card connector which overcomes the disadvantages of the prior art described above and which achieves the miniaturization of connector and has a construction with which preventing troubles caused by electro-static discharge (ESD) and for precluding erroneous insertion of a card with its rear end or upside down at a time.

The above object can be achieved by a card connector 10 into and from which at least one card 60 is inserted and removed, including a plurality of contacts 14 each having a contact portion 141 adapted to contact the card 60, and a housing 12 arranging and holding the contacts 14 and having a fitting opening 24 into which the card 60 is inserted, wherein according to the invention, the housing 12 is provided with a terminal 16 at one end in the width direction of the housing 12 for achieving continuity between the card 60 and a substrate and precluding the card from being erroneously inserted, and the housing is further provided with a notch 26 at a predetermined position for permitting part of the terminal 16 to extend into the fitting opening 24.

In the case that four kinds of cards are used, the above object can be achieved by a card connector 10 into and from which four cards 60 are inserted and removed, including four kinds of contacts 14 each having a contact portion 141 adapted to contact the card 60, and a housing 12 arranging and holding the contacts 14 and having a fitting opening 24 into which the cards 60 are inserted, wherein according to the invention the housing 12 is provided with terminals 16 at one end in the width direction of the housing 12 for achieving each continuity between the card 60 and a substrate and preventing each of the cards 60 from being erroneously inserted, and the housing 12 is further provided with notches 26 each at a predetermined position for permitting part of each of the terminals 16 to extend into the fitting opening 24.

When the card 60 has been normally inserted, the terminal 16 comes into contact with a side edge of the card 60 to achieve continuity between the card 60 and the substrate, and when the card 60 is erroneously being inserted into the card connector 10, the tip of the terminal 16 abuts against an end face of the card 60 to preclude the erroneous insertion of the card 60.

There is provided the terminal 16 which is substantially in the form of an L-shape and comprises a contact portion 161 at one end adapted to contact a side edge of the card 60, a connection portion 143 at the other end adapted to be connected to the substrate, and a fixed portion 162 between the connection portion 163 and the contact portion 161 for fixing the terminal 16 to the housing 12, and the housing 12 is provided at the other end in its width direction with switching means for detecting insertion and removal of the card 60, and is further provided with a notch 28 at a predetermined position in the housing 12 for permitting part of the switching means to extend into the fitting opening 24.

The housing 12 is provided with protrusions 30 in the rear region of the housing 12 for constraining amount of displacement of the contacts 14 and preventing buckling of the contacts 14 when one card 60 is inserted into the card connector 10.

A shell 22 made of a metal is mounted on the housing 12 of the card connector 10 for preventing noise.

As can be seen from the above description, the card connector 10 according to the invention can bring about the following functions and effects.

(1) According to the invention, in a card connector 10 into and from which at least one card 60 is inserted and removed, including a plurality of contacts 14 each having a contact portion 141 adapted to contact the card 60, and a housing 12 arranging and holding the contacts 14 and having a fitting opening 24 into which the card 60 is inserted, the housing 12 is provided with a terminal 16 at one end in the width direction of the housing 12 for achieving continuity between the card 60 and a substrate and precluding the card from being erroneously inserted, and the housing is further provided with a notch 26 at a predetermined position for permitting part of the terminal 16 to extend into the fitting opening 24. Therefore, only one terminal 16 serves to prevent the troubles caused by the electro-static discharge (ESD) and erroneous insertion of a card to contribute to the miniaturization of the connector 10 without giving rise to damage to the connector 10, card 60 and substrate.

(2) In the case that four cards are used, according to the invention, in a card connector 10 into and from which four cards 60 are inserted and removed, including four kinds of contacts 14 each having a contact portion 141 adapted to contact the card 60, and a housing 12 arranging and holding the contacts 14 and having a fitting opening 24 into which the cards 60 are inserted, wherein the housing 12 is provided with terminals 16 at one end in the width direction of the housing 12 for achieving each continuity between the card 60 and a substrate and preventing each of the cards 60 from being erroneously inserted, and the housing 12 is further provided with notches 26 each at a predetermined position for permitting part of each of the terminals 16 to extend into the fitting opening 24. Consequently, only one terminal 16 serves to prevent the troubles caused by the electro-static discharge (ESD) and erroneous insertion of a card to contribute to the miniaturization of the connector 10 without giving rise to damage to the connector 10, card 60 and substrate.

(3) According to the invention, when the card 60 has been normally inserted, the terminal 16 comes into contact with a side edge of the card 60 to achieve continuity between the card 60 and the substrate, and when the card 60 is erroneously being inserted into the card connector 10, the tip of the terminal 16 abuts against an end face of the card 60 to preclude the erroneous insertion of the card 60. Therefore, owing to the measure for preventing erroneous insertion of a card with it rear end, damage to connector 10, card 60 and substrate can be avoided.

(4) According to the invention, the terminal 16 is substantially in the form of an L-shape and comprises a contact portion 161 at one end adapted to contact a side edge of the card 60, a connection portion 143 at the other end adapted to be connected to the substrate, and a fixed portion 162 between the connection portion 163 and the contact portion 161 for fixing the terminal 16 to the housing 12, and the housing 12 is provided at the other end in its width direction with switching means for detecting insertion and removal of the card 60, and is further provided with a notch 28 at a predetermined position in the housing 12 for permitting part of the switching means to extend into the fitting opening 24. Therefore, only one terminal 16 serves to prevent the troubles caused by the electro-static discharge (ESD) and erroneous insertion of a card to contribute to the miniaturization of the connector 10 without giving rise to damage to the connector 10, card 60 and substrate. Moreover, by providing the switching means for detecting the card 60, it is possible to recognize whether the card 60 has been completely inserted or not.

(5) According to the invention, the housing 12 is provided with protrusions 30 in the rear region of the housing 12 for constraining amount of displacement of the contacts 14 and preventing buckling of the contacts 14 when one card 60 is inserted into the card connector 10. Accordingly, damage to the contacts can be avoided and then damage to the connector 10, card 60 and substrate are not caused.

(6) According to the invention, a shell 22 made of a metal is mounted on the housing 12 of the card connector 10. Therefore, noise can be prevented.

The invention will be more fully understood by referring to the following detailed specification and claims taken in connection with the appended drawings.

DESCRIPTION OF THE PREFERRED EMBODIMENT

Figure 1A:
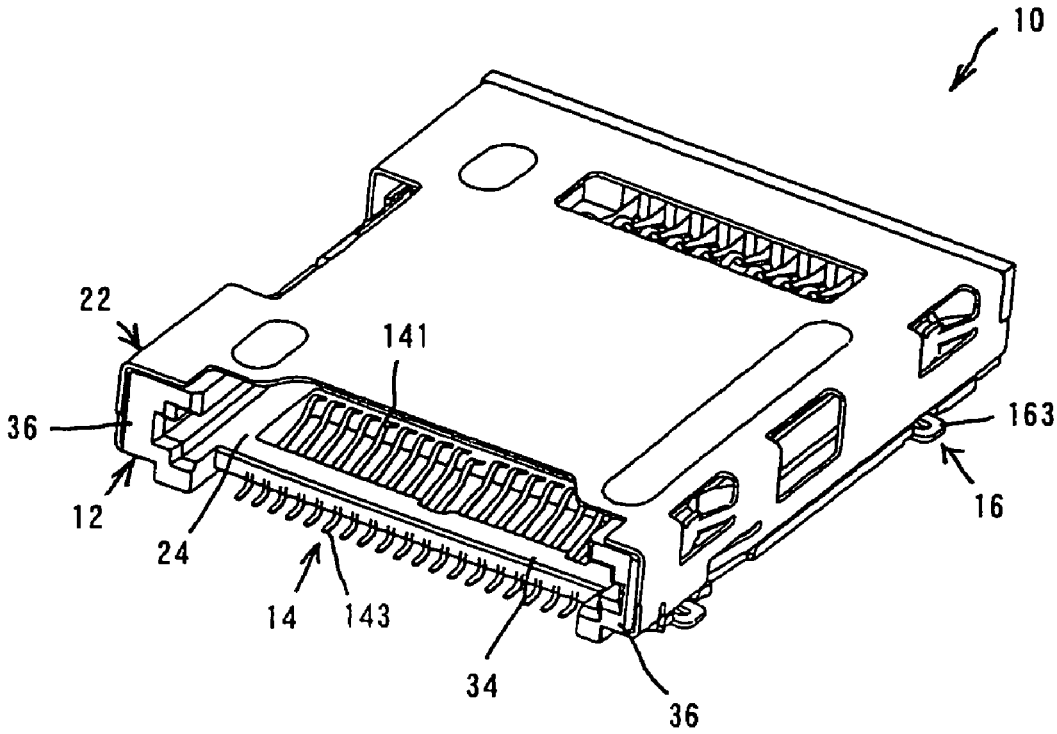
FIG. 1A is a perspective view of a card connector according to the invention viewed from above on the fitting opening side.
Figure 1B:
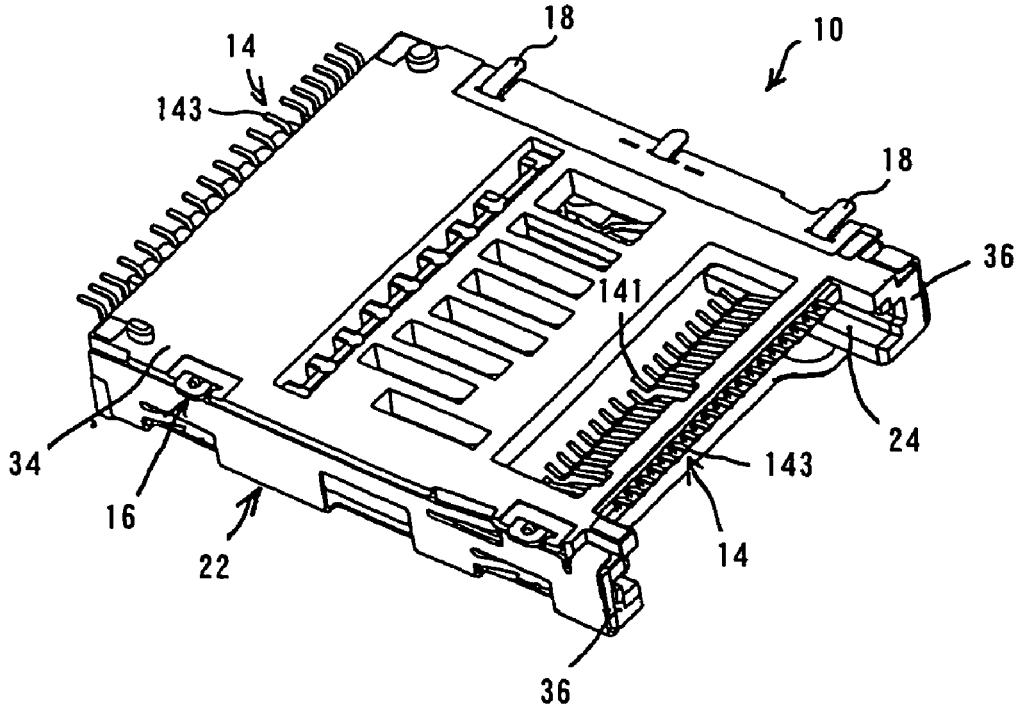
FIG. 1B is a perspective view of a card connector according to the invention viewed from below on the fitting opening side.
Figure 2A:
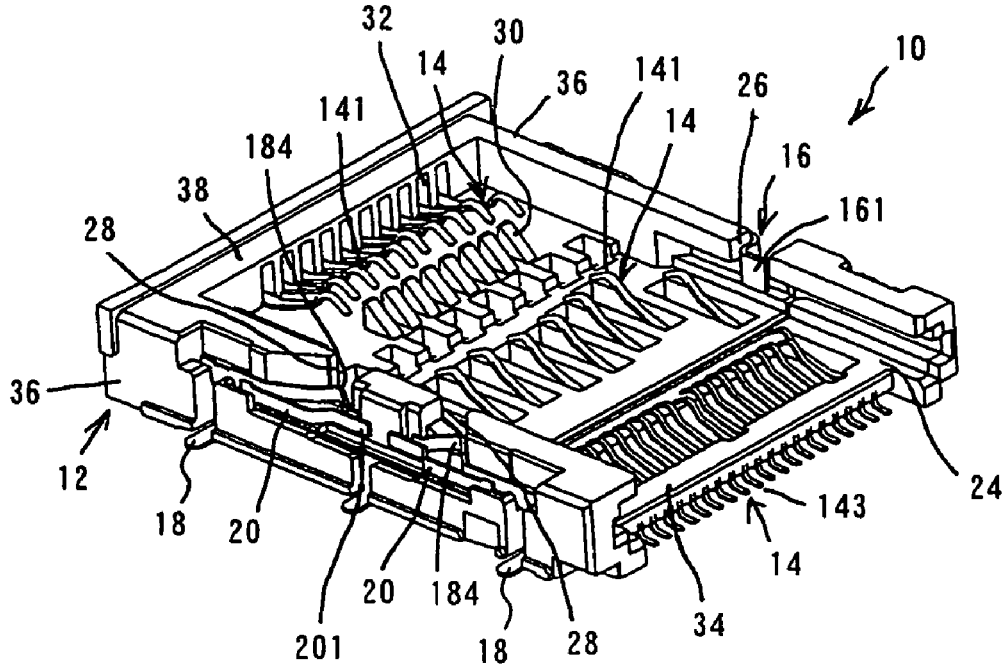
FIG. 2A is a perspective view of the card connector with the shell removed.
Figure 2B:
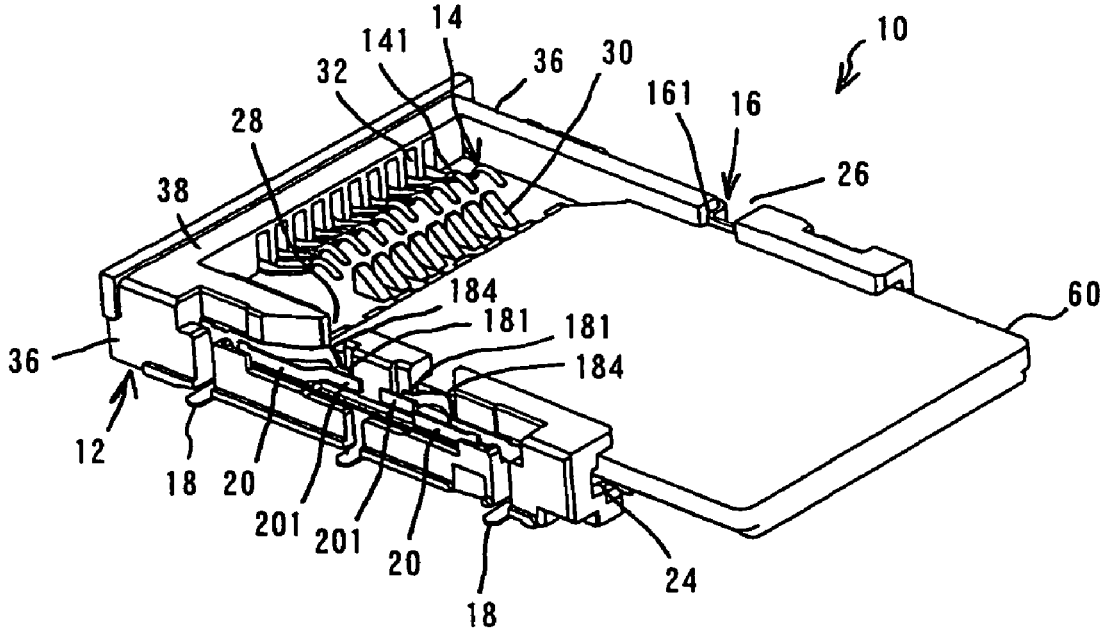
FIG. 2B is a perspective view of the card connector with a card inserted and with the shell removed.
Figure 3:
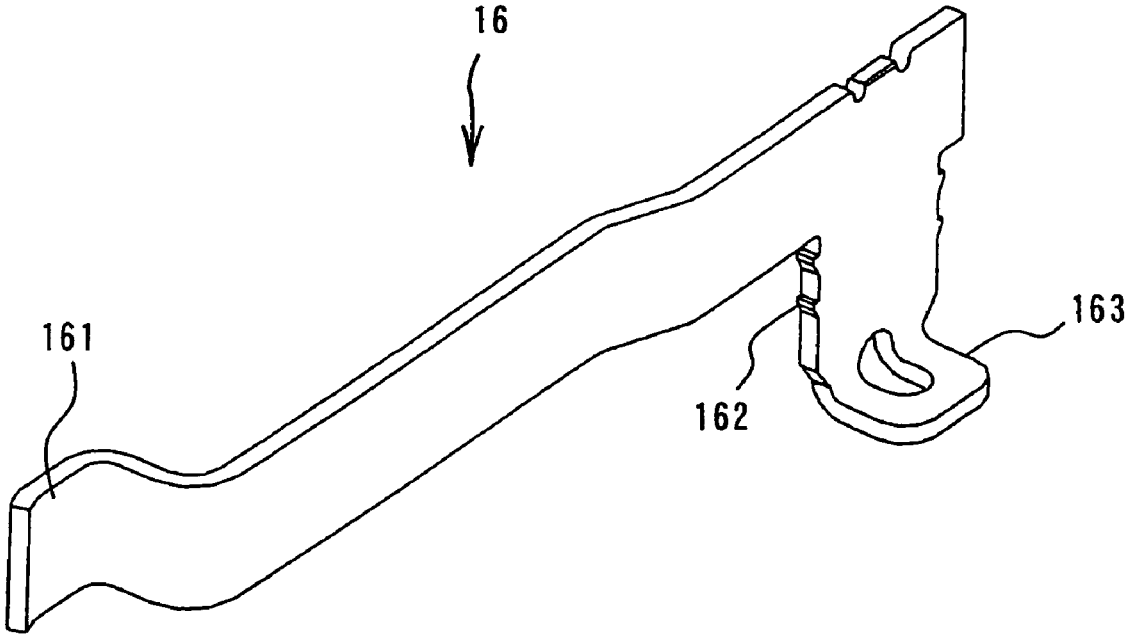
FIG. 3 is a perspective view of a terminal used in the connector according to the invention.
Figure 4A:
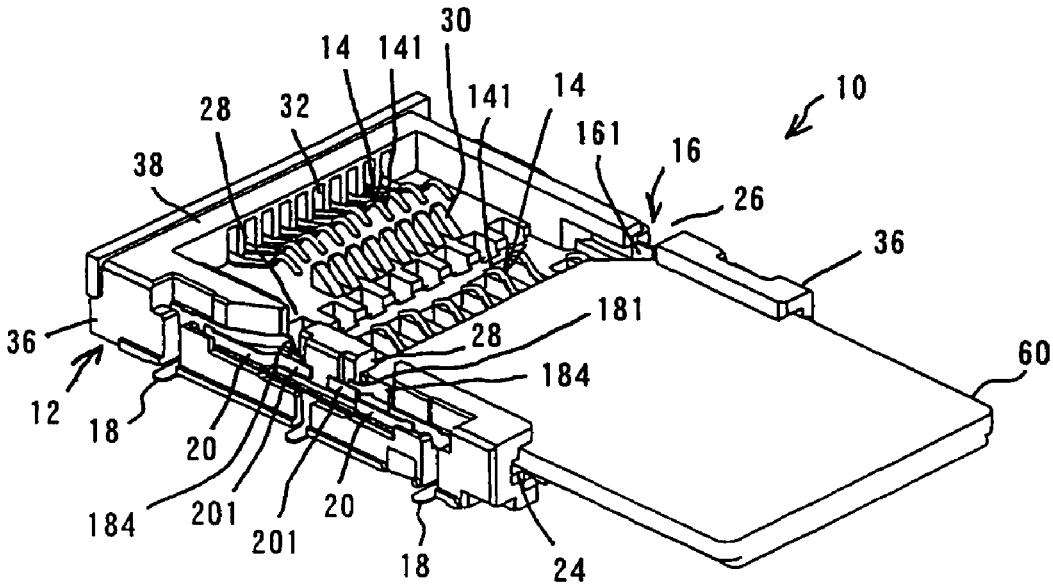
FIG. 4A is a perspective view of the connector according to the invention with a card normally inserted and with the shell removed.
Figure 4B:
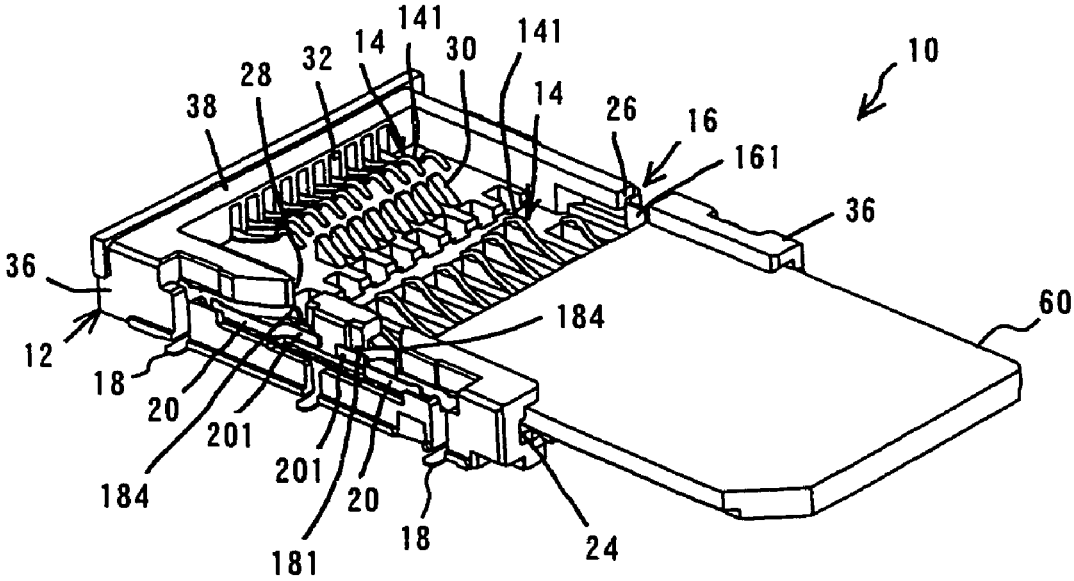
FIG. 4B is a perspective view of the connector according to the invention with a card reversely inserted and with the shell removed.

One embodiment of the invention will be explained with reference to FIGS. 1A to 4B. FIG. 1A is a perspective view of the card connector according to the invention viewed from above on the fitting opening side, while FIG. 1B is a perspective view of the card connector shown in FIG. 1A from below on the fitting opening side. FIG. 2A is a perspective view of the card connector according to the invention with its shell removed, while FIG. 2B is the card connector shown in FIG. 2A into which a card has been inserted, with the shell removed. FIG. 3 is a perspective view of a terminal used in the card connector according to the invention. FIG. 4A is a perspective view of the card connector into which a card is being normally inserted thereinto, with the shell removed, and FIG. 4B is a perspective view of the card connector shown in FIG. 4A into which a card has been erroneously inserted with its rear end, for instance, with the shell removed.

The card connector 10 according to the invention mainly comprises plural kinds of contacts 14, a housing 12, terminals 16, a shell 22, and plural kinds of switch terminals 18, 20.

Before explaining the components of the card connector, the cards 60 will be explained. The cards 60 are used for printers, card readers and the like. The cards 60 each mainly comprise contact portions adapted to contact the contact portions 141 of the contacts 14, patterns connecting from the contact portions of the card to circuits, and connection portions adapted to be connected to integrated circuits and central processing units mounted on the patterns. The cards 60 to be used for the card connector 10 according to the invention include Multimedia card (registered trademark), SD card (Secure Digital memory card) (registered trademark), Mini-SD card (Mini Secure Digital memory card) (registered trademark), Memory Stick card (registered trademark), SmartMedia card (registered trademark), CompactFlash card (registered trademark), xD card (registered trademark), RS-MMC card (Reduce Size MMC card) (registered trademark), Transflash card (registered trademark), S card (registered trademark), and the like, these being IC cards having built-in CPU or IC for memory.

The card connector 10 in the illustrated embodiment has a construction into which four cards can be inserted, an xD card, Memory Stick card, SD card and Multimedia card.

First, the terminal 16 will be explained, which is a subject matter of the invention. The terminal 16 is made of a metal and formed by means of the press-working of the known technique. Preferred metals for the terminal 16 include brass, beryllium copper, phosphor bronze and the like which comply with the requirements such as springiness, workability and the like.

As shown in FIG. 3, the terminal 16 is substantially in the form of an L-shape and includes a contact portion 161 at one end adapted to contact a side edge of a card 60, a connection portion 163 at the other end adapted to be connected to a substrate, and a fixed portion 162 between the connection portion 163 and the contact portion 161 for fixing the terminal 16 to the housing 12. The terminal 16 is fixed to the housing 12 by press-fitting the fixed portion 162 into the housing 12. Although the connection portion 163 is of a surface mounting type (SMT) in consideration of the design of circuits on the substrate in the illustrated embodiment, it may be of a dip type. The contact portion 161 is adapted to contact the side edge of the SD card and is curved to facilitate the contact with the card. The terminal 16 connected to the substrate is brought into contact with the side edge of the card 60 so that continuity between the card 60 and the substrate is achieved to prevent troubles caused by the electro-static discharge (ESD).

The contact portion 161 of the terminal 16 is arranged so as to extend in a notch 26 of the housing 12. It is desirable that the tip of the contact portion 161 is chamfered in C-shape or R-shape or obliquely chamfered to prevent the card 60 from being scratched. The terminal 16 also serves as a reverse insertion preventing structure in a manner that an end face of a card 60 abuts against the tip of the terminal 16 when the card is erroneously inserted with its rear end, for instance, into the card connector. In other words, before the card 60 being in contact with the contact portion 141 of the contact 14, the end face of the card 60 abuts against the tip of the terminal 16 when the card is erroneously inserted with its rear end or upside down into the connector.

The housing 12 will then be explained. The housing 12 is formed from an electrically insulating plastic material by means of the injection molding of the known technique. The materials suitable for the housing 12 include polybutylene terephthalate (PBT), polyamide (66 PA or 46 PA), liquid crystal polymer (LCP), polycarbonate (PC) and the like and combination thereof in consideration of dimensional stability, workability, manufacturing cost and the like. The housing 12 may be provided with a required number of fitting openings 24 into which a plurality of cards are inserted, respectively. In the illustrated embodiment, there is provided only one fitting opening 24. The size of the fitting opening 24 may be suitably designed to allow a required number of cards 60 to be inserted and to bring the respective inserted cards 60 into contact with the contacts 14 and first switch terminals 18 respectively corresponding to the respective cards.

The housing 12 comprises at least a lower wall 34, two side walls 36, and a rear wall 38. One of the side walls 36 is provided with a notch 26 for permitting the contact portion 161 of the terminal 16 to extend into the fitting opening 24. The position of the notch 26 may be suitably designed to cause the card 60 to abut against the terminal 16 before the card 60 contacts the contact portion 141 of the contact 14 when the card 60 is erroneously inserted into the card connector as described above. The size of the notch 26 may be suitably designed to permit the contact portion 161 of the terminal 16 to extend into the fitting opening 24 and further in consideration of the strength of the housing 12 and stabilization of contact between the card 60 and the terminal 16.

The other side wall 36 of the housing 12 is provided with a required number of switch mechanisms for detecting insertion and removal of the cards 60. The switch mechanisms each comprise two terminals (first switch terminal 18 and second switch terminal 20). The other side wall 36 is further provided with a required number of notches 28 at predetermined positions depending on the number of the first switch terminals 18 for permitting parts of the first switch terminals 18 to extend through the respective notches 28 into the fitting opening 24. The position of the notch 28 may be suitably designed so that the first switch terminal 18 is pushed by a card 60 corresponding to the first switch terminal 18 to bring the first switch terminal 18 into contact with the second switch terminal 20. The size of the notch 28 may be suitably designed to permit the contact point 184 of the first switch terminal 18 to extend into the fitting opening 24 and further in consideration of the strength of the housing 12 and reaction between the card 60 and the first switch terminal 18.

The housing 12 is further provided with protrusions 30 on the side of the rear wall 38 for constraining displacements of the contacts 14 and preventing buckling of the contacts 14 when a card 60 is inserted. Positions, sizes and shapes of the protrusions 30 may be suitably designed in consideration of such functions. The protrusions 30 are substantially of triangular pyramids in the illustrated embodiment.

The housing 12 is further provided with a plurality of inserting holes 32 corresponding to the plural kinds of contacts for arranging and holding these required number of contacts therein, respectively. The plural kinds of contacts 14 are fixed to the housing 12 as by press-fitting or integrally molding.

The plural kinds of contacts 14 will then be explained. The plural kinds of contacts 14 are also made of a metal similar to the terminal 16 and formed by means of the press-working of the known technique. Preferred metals from which to form the contacts 14 include brass, beryllium copper, phosphor bronze and the like which comply with the requirements such as springiness, electric conductivity and the like.

The plural kinds of the contacts 14 each include at least a contact portion 141 adapted to contact a corresponding card 60, a fixed portion to be fixed to the housing 12, and a connection portion 143 adapted to be connected to a substrate. The shape of the contact portion 141 is curved to facilitate contacting with the card 60. Although the connection portion 143 of the contact 14 is of a surface mounting type (SMT) in consideration of the design of circuits on the substrate in the illustrated embodiment, it may be of a dip type.

In arranging the plural kinds of the contacts 14 in the illustrated embodiment, the contacts for the xD card are arranged on the side of the fitting opening, the contacts for the Memory Stick card are arranged on the rear side or on the opposite side of the fitting opening, and the contacts for the SD card and Multimedia card are arranged substantially in the intermediate positions between the fitting opening and the rear end, respectively.

The switching mechanisms will then be explained. The switching mechanisms each comprise two terminals (first switch terminal 18 and second switch terminal 20) corresponding to each of the cards. The two terminals are made of a metal and formed by means of the press-working of the known technique. Preferred metals from which to form the switch terminals are brass, beryllium copper, phosphor bronze and the like which comply with the requirements such as springiness, electric conductivity and the like.

The first and second switch terminals 18 and 20 each comprise at least a contact portion 181, 201 adapted to contact the mating switch terminal 20, 18, a fixed portion to be fixed to the housing 12, and a connection portion to be connected to a substrate. Moreover, the first switch terminal 18 is further provided with a contact point 184 which is adapted to be urged by the corresponding card 60 and is curved to prevent the card 60 from being scratched.

The switching mechanisms operate in a following manner. Before the card 60 is inserted into the fitting opening of the card connector, the first and second switch terminals 18 and 20 are separated from each other. When the card 60 has been inserted into the card connector, the contact point 184 of the first switch terminal 18 is urged by the card 60 so as to bring the contact portion 181 of the first switch terminal 18 into contact with the contact portion 201 of the second switch terminal 20 to achieve the continuity between the first and second switch terminals 18 and 20, thereby detecting the insertion of the card 60. The connection portions of the first and second switch terminals 18 and 20 are of a surface mounting type (SMT) in consideration of the design of circuits on the substrate in the illustrated embodiment, it may be of a dip type. The positions of the respective switching mechanisms may be suitably designed in consideration of the sizes of corresponding cards 60 and the function of detection for the inserted cards.

Finally, the shell 22 will be explained. The shell 22 is also made of a metal and formed by means of the press-working of the known technique. Preferred metals for the shell 22 are brass, beryllium copper, phosphor bronze and the like which comply with the requirements such as dimensional stability, workability, springiness and the like. The shell 22 is cross-sectionally substantially U-shaped and is fixed to the housing as by hooking (lancing), press-fitting, and caulking in a manner covering the upper surface of the housing for the purpose of preventing noise.

The present invention is applicable to card connectors for use in electric and electronic appliances in instruments and for use in printers and card readers and particularly to connectors capable of preventing troubles caused by the electro-static discharge (ESD) and avoiding erroneous insertion of a card into the connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A card connector into and from which at least one card is inserted and removed, including a plurality of contacts each having a contact portion adapted to contact said card, and a housing arranging and holding said contacts and having a fitting opening into which said card is inserted, wherein said housing is provided with a terminal at one end in the width direction of the housing, said terminal is substantially in the form of an L-shape and includes a contact portion and a tip at one end contacting a side edge of said card, a connection portion at the other end being connected to a substrate, and a fixed portion between said connection portion and said contact portion, the contact portion contacts the side of said card and carries out the electrical connection of said card and said substrate for preventing interference caused by the electro-static discharae when said card has been normally inserted, and the tip of said contact portion abuts against an end face of said card to mechanically preclude said card from being erroneously inserted, and said housing is further provided with a notch at a predetermined position for permitting part of said terminal to extend into said fitting opening.

2. The card connector as set forth in claim 1, wherein a shell made of a metal is mounted on said housing, the shell being connected to a card with a terminal electrically contacting a side edge of the card for preventing effects caused by the electro-static discharge.

3. The card connector as set forth in claim 1, wherein said housing is provided at the other end in its width direction with switching means for detecting insertion and removal of the card, and is further provided with a notch at a predetermined position in said housing for permitting part of said switching means to extend into said fitting opening.

4. The card connector as set forth in claim 3, wherein the housing is provided with protrusions in the rear region of said housing for constraining amount of displacement of said contacts end preventing buckling of said contacts when one card is inserted into the card connector.

5. The card connector as set forth in claim 3, wherein a shell made of a metal is mounted on said housing, the shell being connected to a card with a terminal electrically contacting a side edge of the card for preventing effects caused by the electro-static discharge.

6. The card connector as set forth in claim 1, wherein the housing is provided with protrusions in the rear region of said housing for constraining amount of displacement of said contacts and preventing buckling of said contacts when one card is inserted into the card connector.

7. The card connector as set forth in claim 6, wherein a shell made of a metal is mounted on said housing, the shell being connected to a card with a terminal electrically contacting a side edge of the card for preventing effect caused by the electro-static discharge.

8. A card connector into and from which four cards are inserted and removed, including four kinds of contacts each having a contact portion adapted to contact said card, and a housing arranging and holding said contacts and having a fitting opening into which said cards are inserted, wherein said housing is provided with terminals at one end in the width direction of the housing, said each terminal is substantially in the form of an L-shape and includes contact portions and a tip at one end contacting a side edge of said card, a connection portion at the other end being connected to a substrate, and a fixed portion between said connection portion and said contact portion, the contact portion contacts the side of said card and carries out the electrical connection of said card and said substrate for preventing interference caused by the electro-static discharge when said card has been normally inserted, and the tip of said contact portion abuts against an end face of said card to mechanically preclude said card from being erroneously inserted, and said housing is further provided with notches each at a predetermined position for permitting part of each of said terminals to extend into said fitting opening.

9. The card connector as set forth in claim 8, wherein said housing is provided at the other end in its width direction with switching means for detecting insertion and removal of the card, and is further provided with a notch at a predetermined position in said housing for permitting part of said switching means to extend into said fitting opening.

10. The card connector as set forth in claim 8, wherein the housing is provided with protrusions in the rear region of said housing for constraining amount of displacement of said contacts and preventing buckling of said contacts when one card is inserted into the card connector.

11. The card connector as set forth in claim 8, wherein a shell made of a metal is mounted on said housing, the shell being connected to a card with a terminal electrically contacting a side edge of the card for preventing effects caused by the electro-static discharge.

* * * * *